US009553412B2

(12) United States Patent
Hsu et al.

(10) Patent No.: US 9,553,412 B2
(45) Date of Patent: Jan. 24, 2017

(54) ELECTRONIC CONNECTOR

(71) Applicant: SPEED TECH CORP., Taoyuan (TW)

(72) Inventors: Chien-Yu Hsu, Taoyuan (TW); Hua-Chun Chang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/940,163

(22) Filed: Nov. 13, 2015

(65) Prior Publication Data

US 2016/0149347 A1 May 26, 2016

(30) Foreign Application Priority Data

Nov. 20, 2014 (TW) ..... 103220699 U

(51) Int. Cl.

| | |
|---|---|
| ***H01R 13/648*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC .. H01R 13/6585; H01R 24/60; H01R 2107/00
USPC ..... 439/607.05, 79
See application file for complete search history.

(56) References Cited

U.S. PATENT DOCUMENTS 7,527,526 B1 * 5/2009 Chen ..... H01R 13/65802 439/607.01
2014/0220827 A1 8/2014 Hsu et al.

* cited by examiner

*Primary Examiner* — Javaid Nasri
(74) *Attorney, Agent, or Firm* — CKC & Partners Co., Ltd.

(57) ABSTRACT

The present disclosure provides a main connector including a shield housing, an insulated body, a plurality of metal terminals, and a shielding plate. The shield housing has an opening for a butt joint connector to insert. The insulated body is encapsulated inside the shield housing. Each of the metal terminals has a contact portion and a fixing portion. The contact portion is arranged in two rows inside the opening of the shield housing, and the fixing portion is fixed to the insulated body. The shielding plate has at least one elastic arm with bending formation and is disposed between two rows of the metal terminals.

2 Claims, 6 Drawing Sheets

ELECTRONIC CONNECTOR

RELATED APPLICATIONS

This application claims priority to Taiwan Application Serial Number 103220699, filed Nov. 20, 2014, which is herein incorporated by reference.

BACKGROUND

Field of Invention

The present disclosure relates to a connector. More particularly, the present disclosure relates to an electrical connector assembly with a grounding structure.

Description of Related Art

Information technology is a booming industry in recent years, and the amount of electronic data transmitted between electronic devices keep increasing. To transmit large amount of electronic data within a short period of time is a developing trend of present information technology. Besides increasing electronic signal transmission channels between connecting electronic devices, general measure of the aforesaid problem is to increase the electronic signal frequency between connecting electronic devices for now. For example, USB 3.0 interface is an information transmission interface with the characteristics of high speed and high bandwidth. This interface has gradually spread to all information products. In addition, the USB connector is a communication bridge of electronic signals between various electronic devices, raising the requirements of the amount of electronic data transmission, and the USB connector is gradually facing the challenge of increasing high frequency signals. Generally speaking, a cable end connector with USB 3.0 specification usually employs a plurality of cables to electrically and mechanically connect to a receptacle connector.

To follow the trend of size reduction in the production of electronic devices, the whole size of the connector is forced to shrink, so as the pitch between conductive terminals become smaller and smaller, which implies that quantity of conductive terminals inside an unit area is increased. That is, electromagnetic interference becomes greater inside the connector. In order to protect the electronic connector from the effects of electromagnetic interference, traditionally the metal housing of connector usually is connected to a grounding circuit or equipment, so that effect of the noise inducing by cables would be diminished.

A practical example of prior art is provided by United States Patent No. 2014/0220827. The reference provides an electronic connector to match to a plug connector and be disposed on a circuit board. The electronic connector includes a insulating housing and a front tongue piece. Two rows of metal terminals are accommodated inside the insulating housing and a shielding plate is inserted between two rows of metal terminals. The shielding plate includes one or more grounding finger and a grounding leg, in which the grounding leg is connected to printed circuit board (PCB), and each grounding finger is disposed between two adjacent differential signal terminal pairs and parallel to a contact portion of the terminal. The reference provides an embedded shielding plate disposed inside the inner of the electronic connector to practically function as a grounding circuit for metal terminals of electronic connector. When the plug connector is inserted to the electronic connector of this reference, the shielding plate and grounding equipment of the plug connector are unable to reach the embedded shielding plate to connect, so that electric charges from the plug connector is also unable to reach the grounding, which may lead to lessen electromagnetic interference.

Therefore, to design an electrical connector assembly with a grounding structure is in need. The present disclosure is able to fulfill this need.

SUMMARY

An aspect of the present disclosure is to provide a connector having a grounding structure.

According to a main embodiment of the present disclosure, the present disclosure provides a main connector including a shield housing, an insulated body, a plurality of metal terminals, and a shielding plate. The shield housing has an opening for a butt joint connector to insert. The insulated body is encapsulated inside the shield housing. Each of the metal terminals has a contact portion and a fixing portion. The contact portion is arranged in two rows inside the opening of the shield housing, and the fixing portion is fixed to the insulated body. The fixing portion has at least one elastic arm with bending formation. The shielding plate is disposed between two rows of the metal terminals. The shielding plate has at least one elastic arm with a bending formation and is disposed between two rows of the metal terminals.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
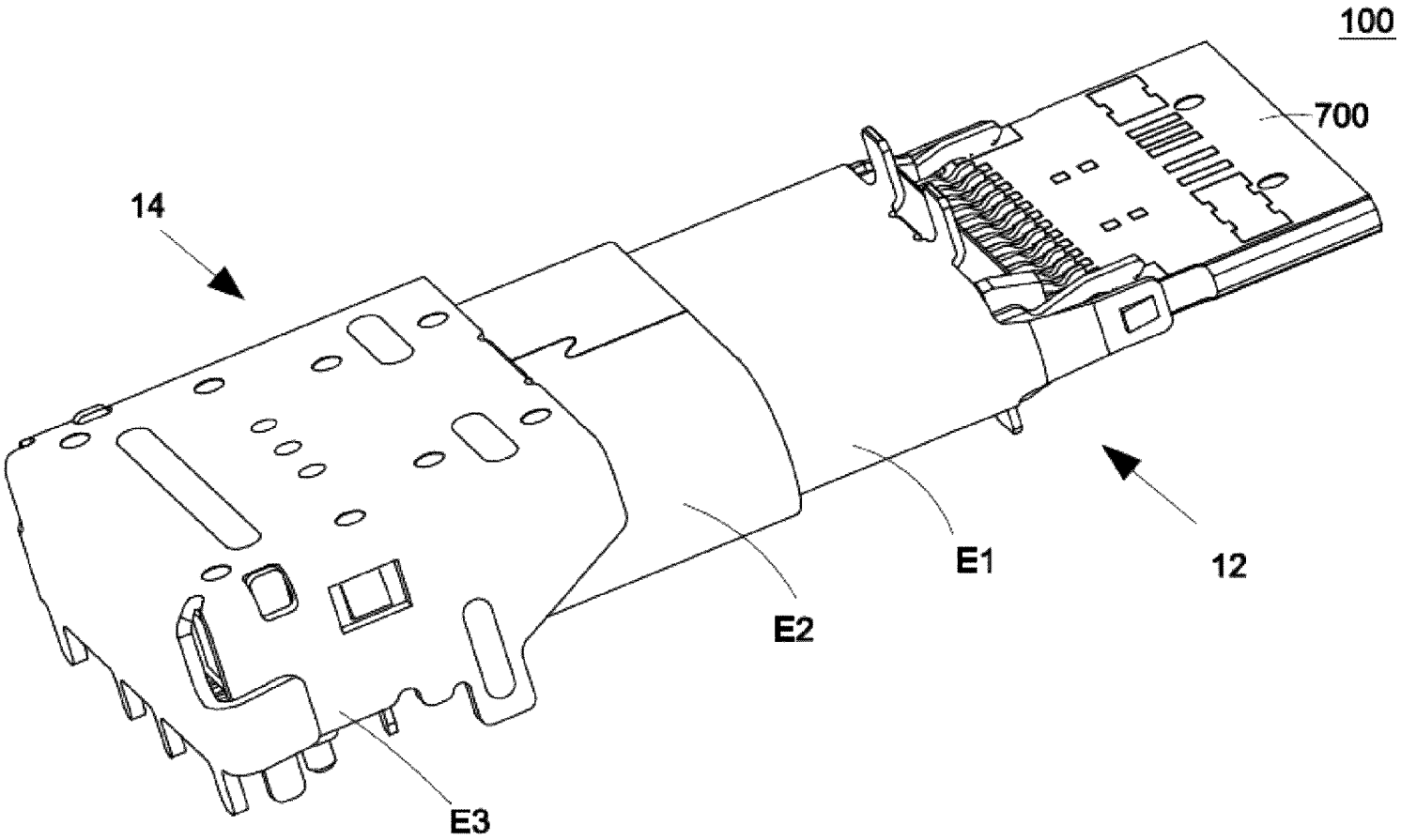
FIG. 1 is an outside view of an electrical connector assembly according to an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in portions of embodiments of the present invention. Furthermore, for simplifying the drawings, some of the conventional structures and elements are shown with schematic illustrations.

Figure 2A:
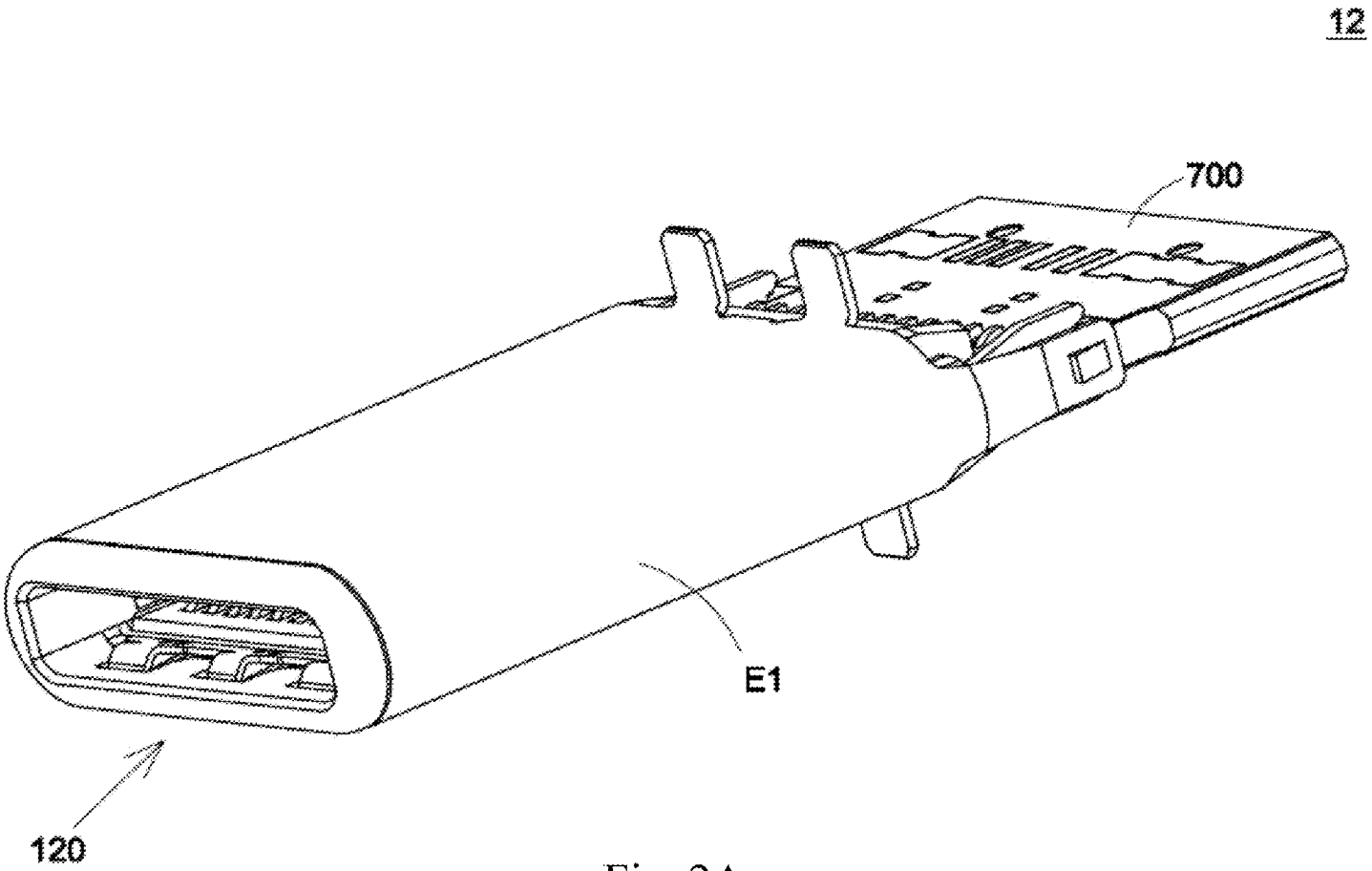
FIG. 2A is an outside view of a plug connector of the electrical connector assembly according to an embodiment of the present disclosure.
Figure 3A:
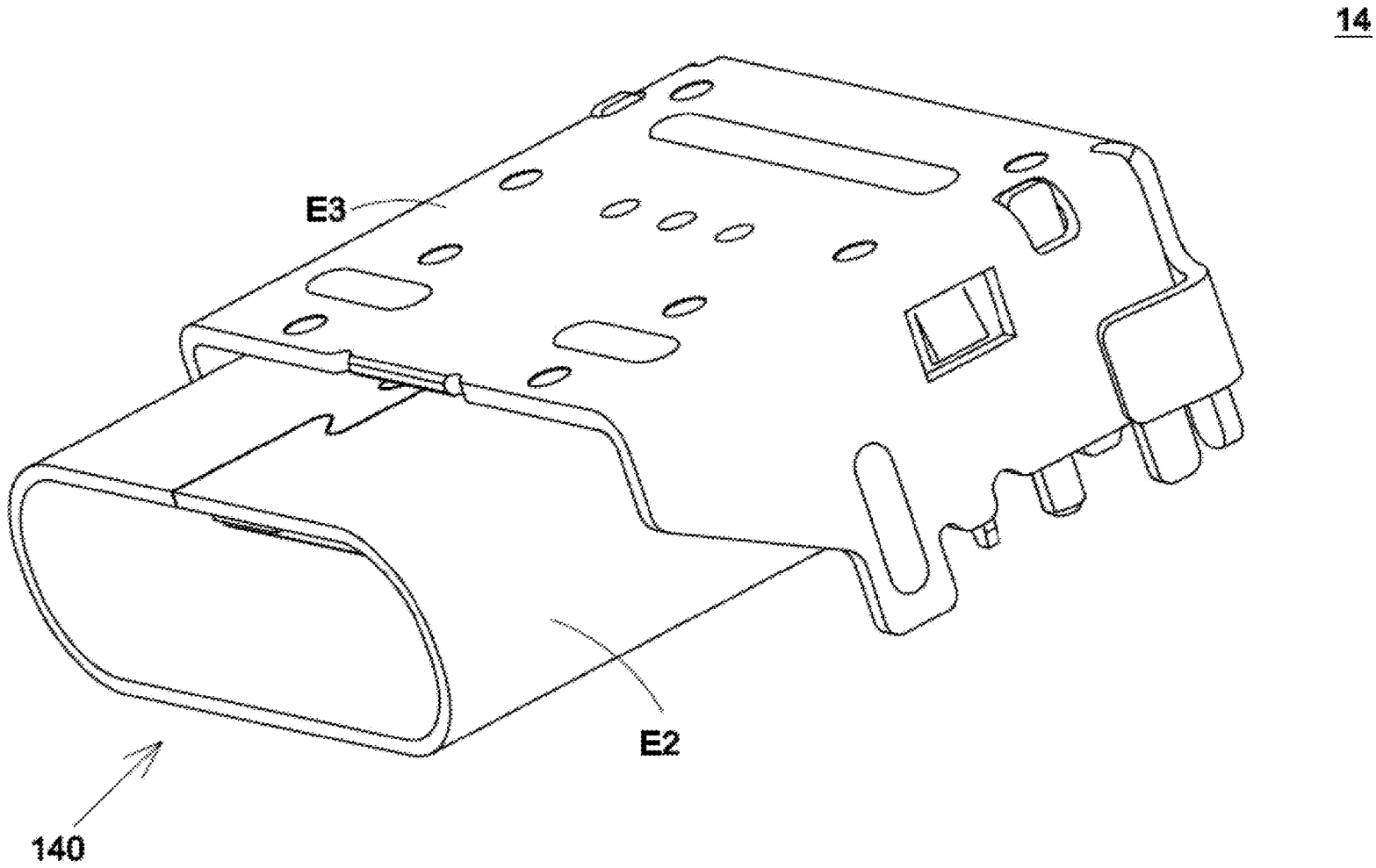
FIG. 3A is an outside view of a receptacle connector of the electrical connector assembly according to an embodiment of the present disclosure.
Figure 3B:
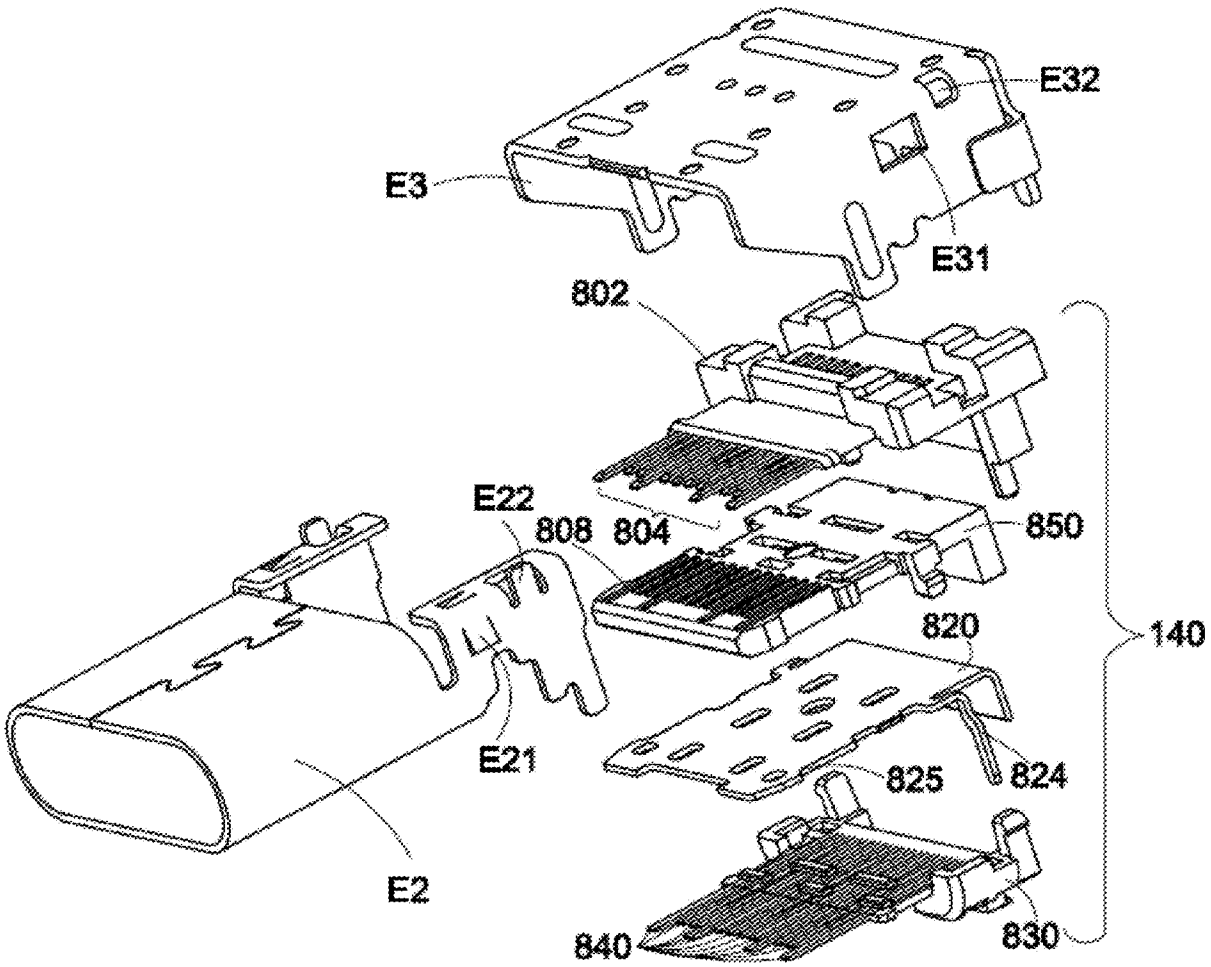
FIG. 3B is an exploded view of the receptacle connector of the electrical connector assembly according to an embodiment of the present disclosure.

Referring to FIG. 1, which illustrates an outside view of an electrical connector assembly 100 of the present disclosure. As shown in FIG. 1, the present disclosure provides an electrical connector assembly 100. The electrical connector assembly 100 includes a plug connector 12 serving as a male connector and a receptacle connector 14 serving as a female connector. The plug connector 12 (male connector) is a main connector and usually includes a first main body 120 (as shown in FIG. 2A) and a first metal housing E1. The first metal housing E1 encapsulates the first main body 120. The receptacle connector 14 (female connector) is a butt joint connector and usually includes a second main body 140 (as shown in FIGS. 3A and 3B), a second metal housing E2, and a metal cover E3. The second metal housing E2 and the metal cover E3 encapsulate the second main body 140. The composition structures of the plug connector 12 (male connector) and the receptacle connector 14 (female connector) are described below.

Figure 2B:
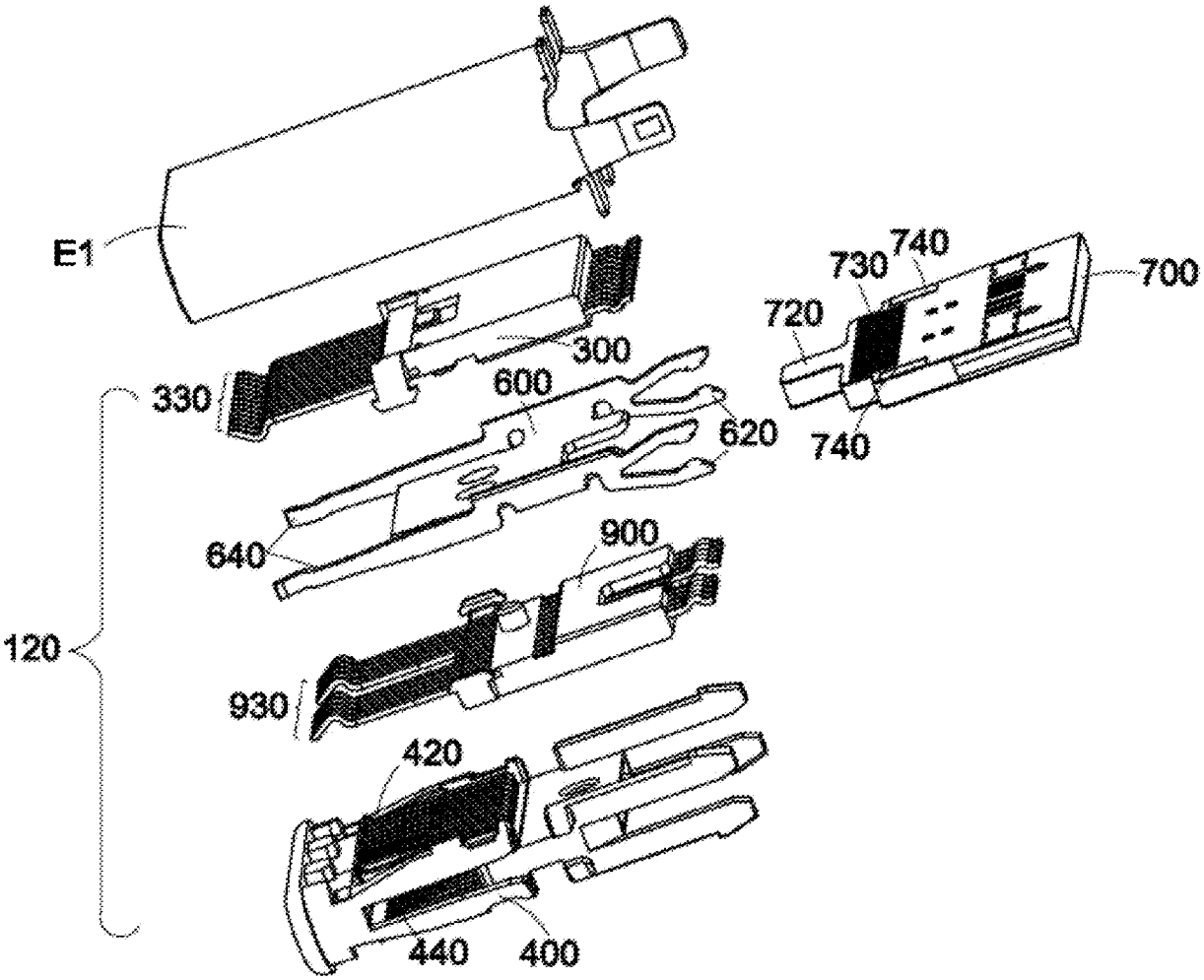
FIG. 2B is an exploded view of the plug connector according to the present disclosure.

Referring to FIG. 2A and FIG. 2B, in which FIG. 2A illustrates an outside drawing of the plug connector 12 in the electrical connector assembly according to an embodiment of the present disclosure, and FIG. 2B illustrates an exploded drawing of the plug connector 12 of the present disclosure. It is noted that same or substantially similar elements has same reference number throughout the specification. As shown in FIG. 1B, the plug connector 12 of the present disclosure includes the first main body 120 encapsulated inside first metal housing E1, in which the first main body 120 includes an upper unit 300, a lower unit 900, a plastic base 400, a first shielding plate 600, a plurality of first metal terminals 330, a plurality of second metal terminals 930, and a circuit board 700. The upper unit 300, the lower unit 900, and the plastic base 400 are assembled to form an insulated body. The first metal terminals 330 are fixed inside the upper unit 300. The second metal terminals 930 are fixed inside the lower unit 300. The first shielding plate 600 is located between the first metal terminals 330 and the second metal terminals 930 and disposed between the upper unit 300 and the lower unit 900. The circuit board 700 includes a plurality of pads 730 located at front ends of an upper surface and a lower surface of the circuit board 700. The first metal terminals 330 and the second metal terminals 930 are connected to the pads 730 respectively. The circuit board 700 includes a rectangle protruding 720 located at the front end of the circuit board 700. The rectangle protruding 720 is configured to engage with a depressed portion on the rear part of the first shielding plate 600, so that the circuit board 700 is connected to the first shielding plate 600. An end of each of the first metal terminals 330 and an end of each of the second metal terminals 930 are connected to the corresponding pads 730 respectively. When the upper unit 300, the lower unit 900, and the first shielding plate 600 are assembled together to form an assembly, the assembly is disposed inside the plastic base 400.

In the present embodiment, the first metal terminals 330 are formed by insert molding inside first slots 420 of the plastic base 400, and the second metal terminals 930 are formed by insert molding inside second slots 440 of the plastic base 400.

Besides, the circuit board 700 further includes grounding pads 740 located at the front ends of the upper surface and the lower surface of the circuit board 700, and the first shielding plates 600 includes an extending portion 620. The extending portion 620 is stretched out from the rear part of the first shielding plates 600 to contact the grounding pads 740. Electrical charges on the first shielding plates 600 are able to be grounded thereby the foresaid path. In addition, the first shielding plate 600 further includes a pair of elastic arms 640 respectively disposed on the opposite broadsides of the first shielding plates 600 and stretched out. The elastic arms 640 are respectively located on both sides of the first metal terminals 330 and the second metal terminals 930, and the structure of outreach end of the elastic arms 640 is partly bent to form a coupler.

Referring to FIG. 3A and FIG. 3B, in which FIG. 3A illustrates an outside view of a receptacle connector 14 of the electrical connector assembly according to an embodiment of the present disclosure, and FIG. 3B illustrates an exploded view of a receptacle connector 14 of the electrical connector assembly according to an embodiment of the present disclosure. As shown in FIG. 3A, the receptacle connector 14 of the electrical connector assembly 100 in the present disclosure includes the second main body 140 and the second metal housing E2 encapsulate the second main body 140. The receptacle connector 14 further includes the metal cover E3 connected to the back end of the second metal housing E2. The back end of the second metal housing E2 has two opposite broadsides, both the opposite broadsides have a bump E21 and a flange E22, and both the opposite broadsides of the metal cover E3 have a corresponding design such as an opening E31 and a trench E32. While assembling the second metal housing E2 and the metal cover E3, the metal cover E3 can be assembled to the back end of the second metal housing E2 by means of coupling the bump E21 with the opening E31 and coupling the flange E22 with the trench E32, as shown in FIG. 3B. As shown in FIG. 3B, the second main body 140 includes a tongue piece 850, an upper base portion 802, a lower base portion 830, a plurality of third metal terminals 804, a plurality of fourth metal terminals 840, and a second shielding plate 820. The tongue piece 850 has a plurality of terminal slots 808 respectively located at upper and lower surfaces of the tongue piece 850. The upper base portion 802 is securely connected to the tongue piece 850, and the third metal terminals 804 are embedded in-between the upper base portion 802 and the tongue piece 850. Preferably, the third metal terminals 804 are formed by insert molding inside the terminal slots 808 on the upper surface of the tongue piece 850. The fourth metal terminals 840 are embedded in-between the lower base portion 830 and the tongue piece 850. Preferably, the fourth metal terminals 840 are formed by insert molding inside the terminal slots 808 below the lower surface of the tongue piece 850. Therefore, the tongue piece 850 is held by the upper base portion 802 and the lower base portion 830. The second shielding plate 820 is partially embedded in the tongue piece 850 and partially stretched out of the tongue piece 850.

In addition, two opposite broadsides of the second shielding plate 820 has two grooves 825 respectively located at two opposite broadsides of the second shielding plate 820. The second shielding plate 820 further includes a pair of grounding legs 824 disposed at two opposite corners on the back end of the second shielding plate 820.

Figure 4:
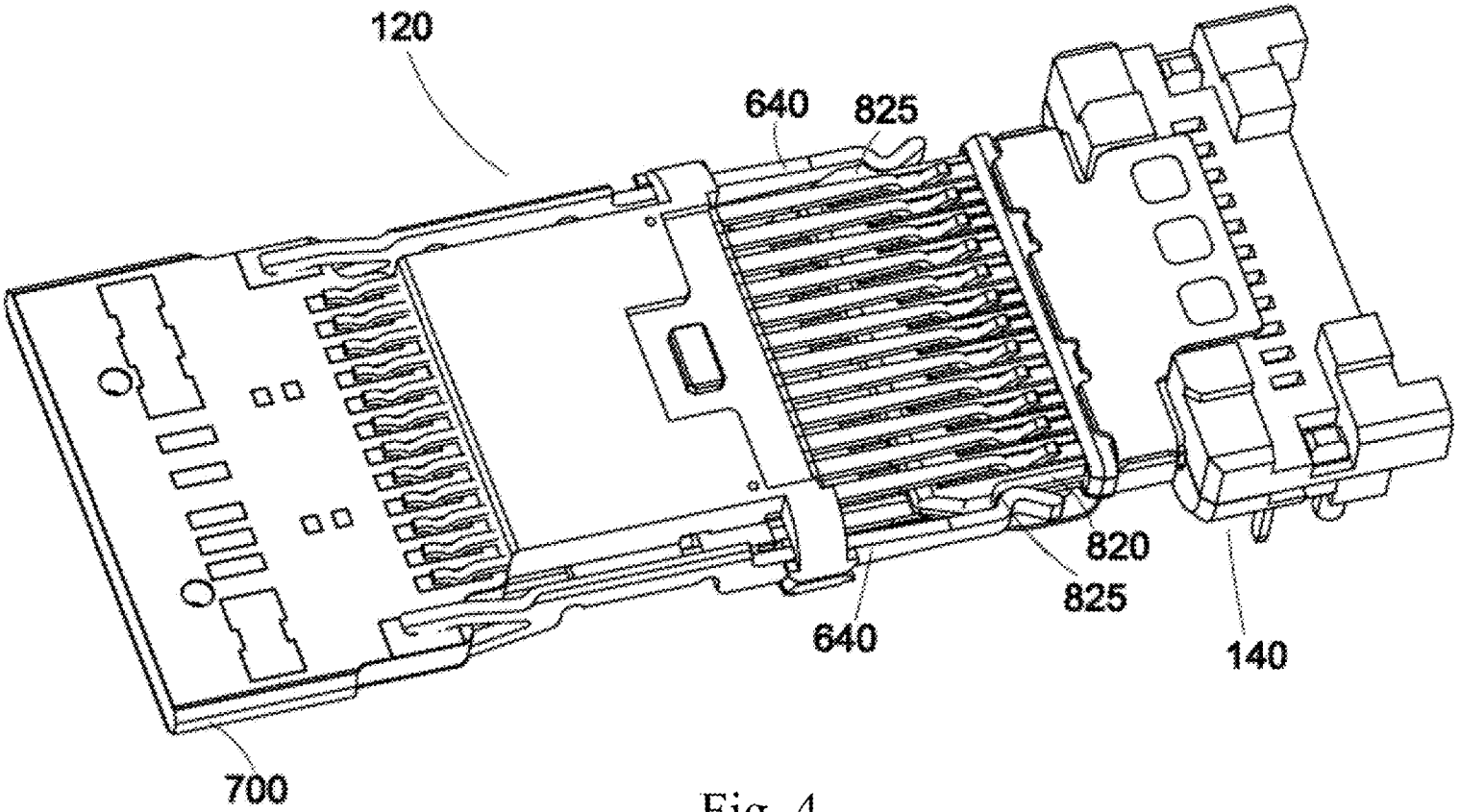
FIG. 4 is a perspective view of a main body of the plug connector jointing a main body of the receptacle connector according to an embodiment of the present disclosure.

Referring to FIG. 4, in which illustrates a perspective view of a main body of the plug connector jointing a main body of the receptacle connector of the present disclosure. While the plug connector 12 inserts into the receptacle connector 14, the first metal terminals 330 of the plug connector 12 contacts the third metal terminals 804 of the receptacle connector 14, so as to transmit signals or provide electric power source. In addition, the elastic arms 640 of the plug connector 12 contacts the grooves 825 respectively located at both opposite broadsides of the second shielding plate 820 in the receptacle connector 14. Therefore, electric charges on the first shielding plates 600 can be discharged rapidly through the second shielding plate 820 to grounding ends of the circuit board (not shown in figure) disposed in the receptacle connector 14.

Summarized from the above, the present disclosure provides an electrical connector assembly including a plug connector and a receptacle connector. The plug connector includes a first metal housing and a first main body, and the receptacle connector includes a second metal housing and a second main body. The first main body includes an elastic arm contacting a groove located at a broadside of the second shielding plate in the receptacle connector, such that electromagnetic interference and noise of the plug connector are able to be diminished rapidly through the second shielding plate in the receptacle connector. Therefore, the electrical connector assembly of the present disclosure can provide a discharge path for the shielding plate discharging.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A main connector, comprising:

a shield housing having an opening for a butt joint connector to insert;

an insulated body encapsulated inside the shield housing, the insulated body comprising:

an upper unit;

a lower unit; and a plastic base configured to accommodate the upper unit and the lower unit;

a plurality of metal terminals, wherein each of the metal terminals has a contact portion and a fixing portion, wherein the contact portions are arranged in two rows inside the opening of the shield housing, and the fixing portions are fixed to the upper unit of the insulated body or the lower unit of the insulated body, and the fixing portions are further inserted inside the plastic base; and a shielding plate having at least one elastic arm with bending formation, wherein the shielding plate is disposed between two rows of the metal terminals.

2. The main connector of claim 1, further comprising:

a circuit board configured to connect to an end of each of the metal terminals.

* * * * *